United States Patent [19]

Sedgwick

[11] 3,952,504

[45] Apr. 27, 1976

[54] FLAME TUBES

[75] Inventor: Gordon Sedgwick, Lancashire, England

[73] Assignee: Joseph Lucas (Industries) Limited, Birmingham, England

[22] Filed: Dec. 14, 1973

[21] Appl. No.: 424,736

[52] U.S. Cl. ..... 60/39.69; 431/353
[51] Int. Cl.[2] ..... F02G 1/00
[58] Field of Search ..... 60/39.65, 39.69; 431/353

[56] References Cited

UNITED STATES PATENTS 3,854,503 12/1974 Nelson et al. ..... 60/39.65

*Primary Examiner*—Samuel Feinberg
*Attorney, Agent, or Firm*—Holman & Stern

[57] ABSTRACT

A flame tube for a gas turbine engine which is arranged within an annular casing and comprising two rows of silicon nitride rings, with one row being disposed adjacent an inner annular wall of the casing and the other row being disposed adjacent an outer annular wall of the casing. Each row is urged into engagement with shoulders at one end of the casing by a clamping arrangement at the opposite end of the casing.

10 Claims, 5 Drawing Figures

FLAME TUBES

BACKGROUND OF THE INVENTION

This invention relates to flame tubes for gas turbine engines.

SUMMARY OF THE INVENTION

According to the present invention, there is provided a flame tube for a gas turbine engine, comprising a plurality of monolithic ceramic rings mounted in a casing in a side-by-side row, fixed abutment means at one end of the row of ceramic rings, and clamping means at the opposite end of the row urging said row against the abutment means.

The ceramic may be silicon nitride.

Most advantageously, the mutually abutting ends of the ceramic rings present surfaces which are angled with respect to a radius of the flame tube.

The flame tube may be of the annular type and have the row of ceramic rings mounted radially inwardly of an outer annular wall of the casing and a further row of ceramic rings spaced radially inwardly of the first-mentioned row of ceramic rings and adjacent an inner annular wall of the casing, with the further row of ceramic rings being urged against further abutment means by further clamping means.

Most preferably, abutment surfaces between the abutment means and the respective rows of ceramic rings and between the clamping means and the respective rows of ceramic rings are so arranged that they lie on straight lines emanating from a point on the axis of the annular flame tube.

The abutment surfaces between the abutment means and the respective rows of ceramic rings may lie on a conical surface or surfaces having its or their apices lying on said point.

The abutment surfaces between the clamping means and the respective rows of ceramic rings may lie on radii to the flame tube emanating from said point or may lie in conical surfaces having their apices lying on said point depending upon the cone angle or angles of the abutment surfaces between the abutment means and respective rows of ceramic rings.

The clamping means for the respective rows of ceramic rings may be carried on common clamping yokes angularly spaced apart around the axis of the flame tube and adjustable towards and away from the abutment means.

The mutually abutting ends of the ceramic rings of the first-mentioned row may lie in conical surfaces which converge to their respective apices away from the abutment means for the row.

The mutually abutting ends of the ceramic rings of the further row may lie in conical surfaces which converge to their respective apices towards the abutment means for the further row.

The arrangement of the rings with respect to one another and with respect to the abutment means and the clamping means is intended to permit relative sliding movement between the rings and the clamping and abutment means to maintain the clamping pressure therebetween substantially constant in spite of any relative expansion and contraction, in use, between the rings and the casing.

Embodiments of the present invention will now be described by way of example, with reference to the accompanying drawings, in which:

DETAILED DESCRIPTION OF THE EMBODIMENTS

Figure 1:
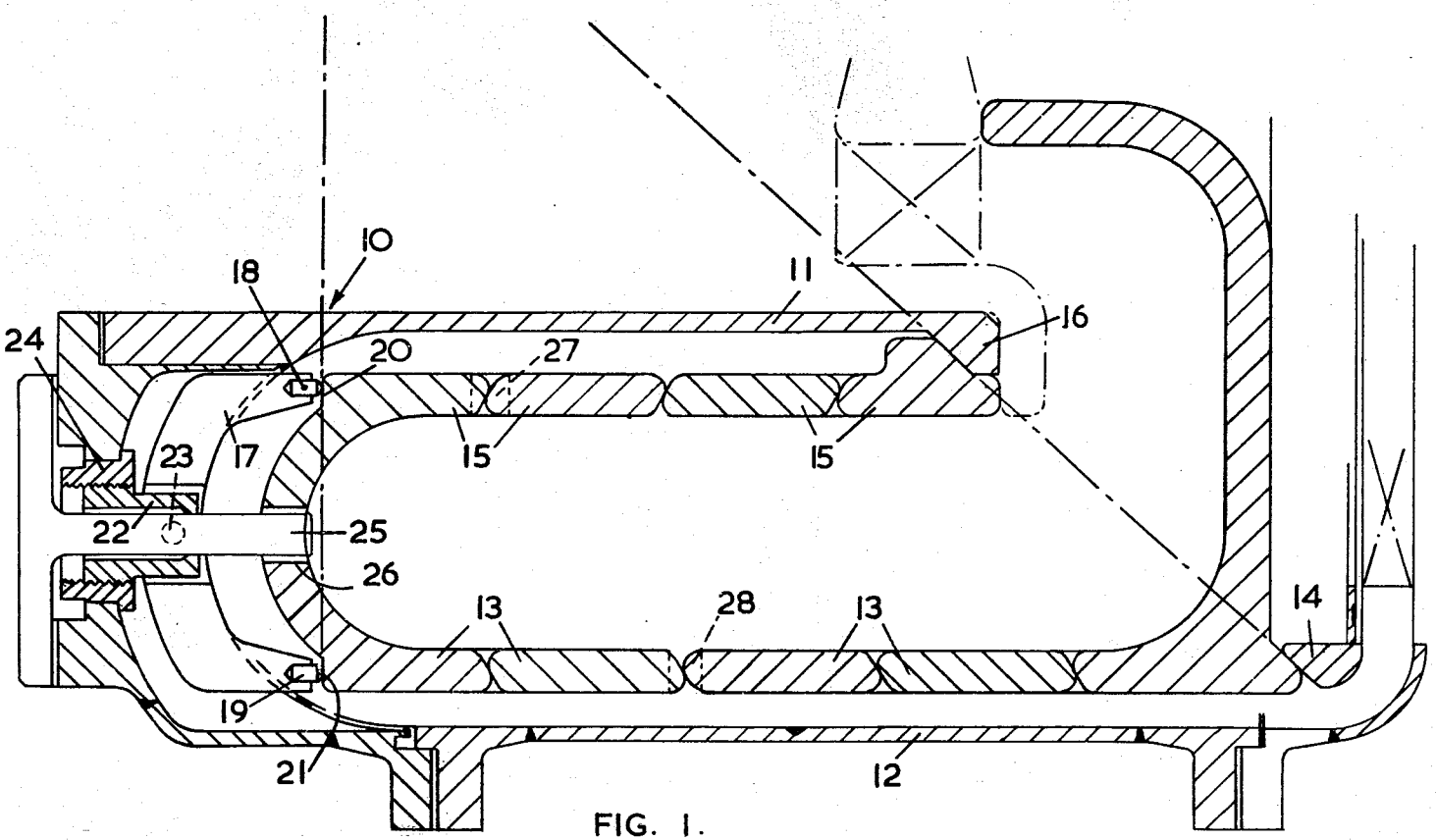
FIG. 1 is a longitudinal sectional view of part of a flame tube according to the present invention.
Figure 2:
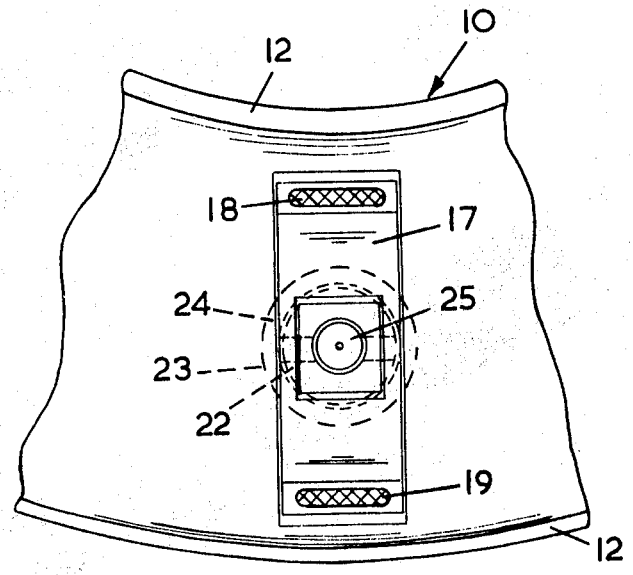
FIG. 2 is a view of part of the flame tube of FIG. 1 in the direction of arrow *a*.

Referring to FIGS. 1 and 2 of the drawings, the flame tube which is annular, generally comprises a casing 10 having an inner annular wall 11 and an outer annular wall 12. Mounted radially inwardly of the outer annular wall 12 is a first row of monolithic silicon nitride rings 13. The rings 13 are mounted in side-by-side relationship and a fixed, annular, metal abutment member 14 is provided at one end of the first row of rings 13. Mounted in the casing 10 adjacent the inner annular wall 11 and radially inwardly of the first row of rings 13 is a further row of monolithic silicon nitride rings 15 which abuts at one end against a fixed, annular, metal abutment member 16 formed integrally with the inner annular wall 11. As can be seen from FIG. 1, the respective mutually engaging ends of the rings 13 and 15 lie in conical abutment surfaces which converge, respectively, away from and towards the respective abutment members 14 and 16. The ring 13 adjacent to the abutment member 14 is of U-shaped section and presents an abutment surface with the abutment member 14 which lies in a conical surface having an apex lying at a point (not shown) on the axis of the annular flame tube. Similarly, the ring 15 adjacent the abutment member 16 abuts thereagainst over a surface which lies in the same conical surface.

At the opposite end of the rows of rings 13 and 15 to the abutment members 14 and 16, the respective rings 13 and 15 are of generally arcuate section and are engaged by a plurality of common clamping yokes 17 which are spaced angularly about the axis of the flame tube. Each yoke 17 is provided with a pair of clamping pads 18 and 19 which engage the first row of rings 13 and further row of rings 15, respectively over abutment surfaces 20 and 21 lying on a radii of the flame tube emanating from the aforementioned point on the flame tube axis. It will be seen from FIG. 2 that the pads 18 and 19 are extended in a circumferential direction with respect to the flame tube.

Each clamping yoke 17 is mounted on an externally screwthreaded sleeve 22 via a pivot 23. The sleeve 22 meshes with a captive nut 24 so that rotation of the captive nut 24 causes axial movement of the sleeve 22 and corresponding axial adjustment of the clamping yoke 17 towards or away from the abutment members 14 and 16 depending upon the direction of rotation of the nut 24. The sleeve 22 accommodates a fuel atomizer nozzle assembly 25 which is adapted to produce a fanshaped spray pattern. The nozzle assembly 25 projects through an aperture 26 defined by a pair of aligned recesses in the rings 13 and 15 against which the yokes 17 abut. Further apertures 27 and 28 are provided in the flame tube for admission of combustion and dilution air and these apertures 27 and 28 are similarly formed by aligned recesses formed in abutting ends of rings 13 and 15. In order to ensure correct alignment of the respective recesses to define apertures 26, 27 and 28, the respective rings 13 and 15 are provided with mutually interengaging lugs and recesses (not shown).

Figure 3:
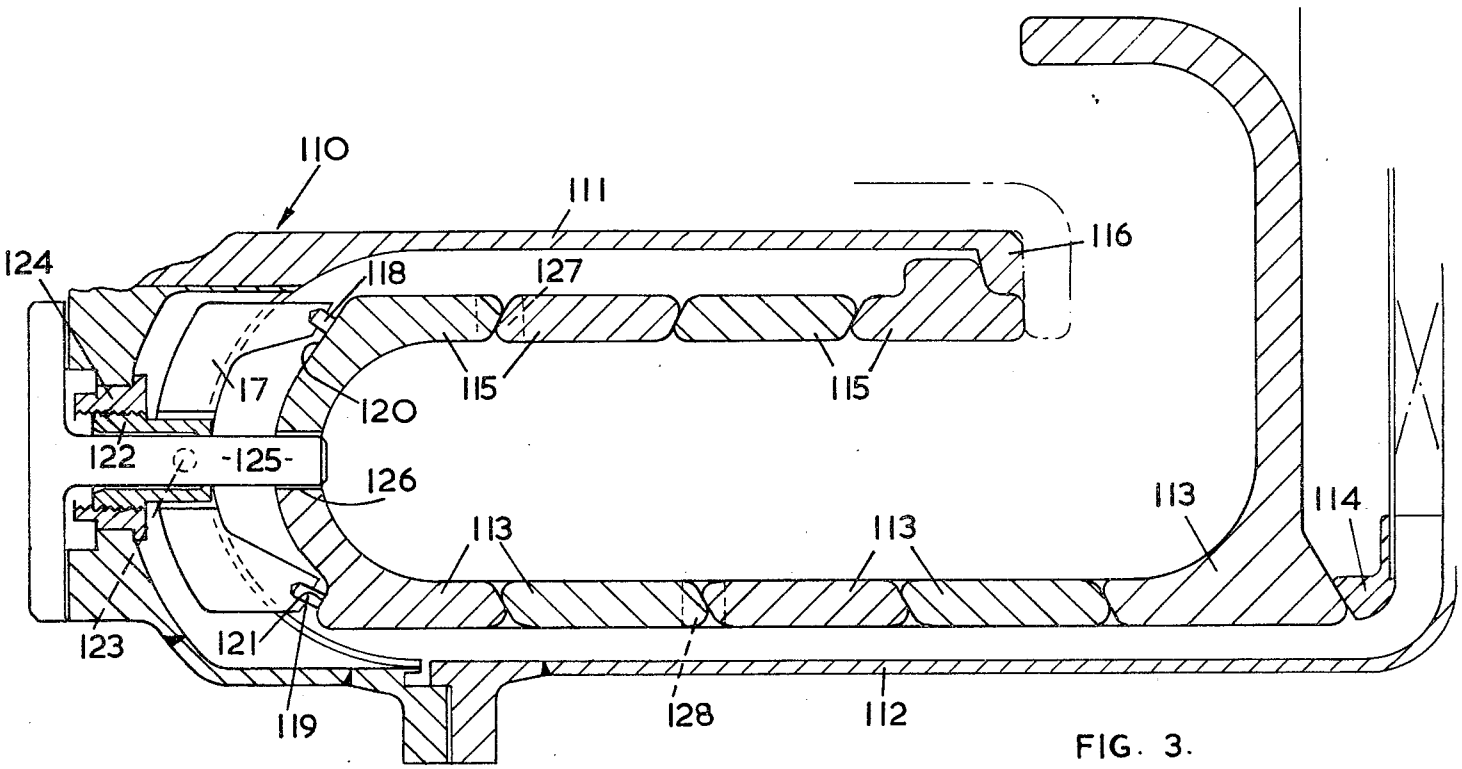
FIG. 3 is a longitudinal sectional view of part of a flame tube according to the present invention illustrated with a different form of clamp to that shown in FIG. 1.

Referring now to FIG. 3 of the drawings, the flame tube construction illustrated therein is virtually identical to the flame tube construction of FIGS. 1 and 2 and similar parts have been accorded corresponding reference numerals except for a prefixed numeral 1. The sole differences between the embodiment of FIGS. 1 and 2 and that of FIG. 3 is that the pads 118 and 119 of each clamping yoke 117 act on surfaces 120 and 121 which lie in conical surfaces whose apices lie on the same point on the flame tube axis. Furthermore, the abutment surfaces between the abutment member 116 and the adjacent ring 115 and the abutment member 114 and the adjacent ring 113 lie in different conical surfaces. However, both of these different conical surfaces have apices lying on the aforementioned same point on the flame tube axis. In the embodiment of FIG. 3, it will be noted that the abutment surface on the ring 113 which engages the abutment member 114 is advantageously carried on a rather larger projection than the corresponding abutment surface of the FIG. 1 embodiment.

It will be seen from both of the above-described embodiments that the abutment surfaces between the clamping pads and the respective rows of rings and between the abutment members and the respective rows of rings lie on straight lines emanating from a single point on the axis of the annular flame tube.

The above-described types of flame tube construction according to the invention are designed to provide a high heat resistance coupled with the facility for relative movement between the rings and the abutment members and yokes in order to compensate for relative expansion and contraction between the casing and the rows of rings 13 and 15 so as to maintain a substantially constant clamping pressure between the rings. Furthermore, the provision of a plurality of rings assists in limiting the adverse effects of temperature gradient longitudinally of the flame tube.

It will furthermore be manifest that the ceramic rings can be readily stacked into the required position from the end of the casing 10 opposite to the abutment members 14 and 16 and that they are self-centralizing due to the inclined ends thereof as well as being easy to align in the correct way by the provision of the interengaging tongues and grooves.

Figure 4:
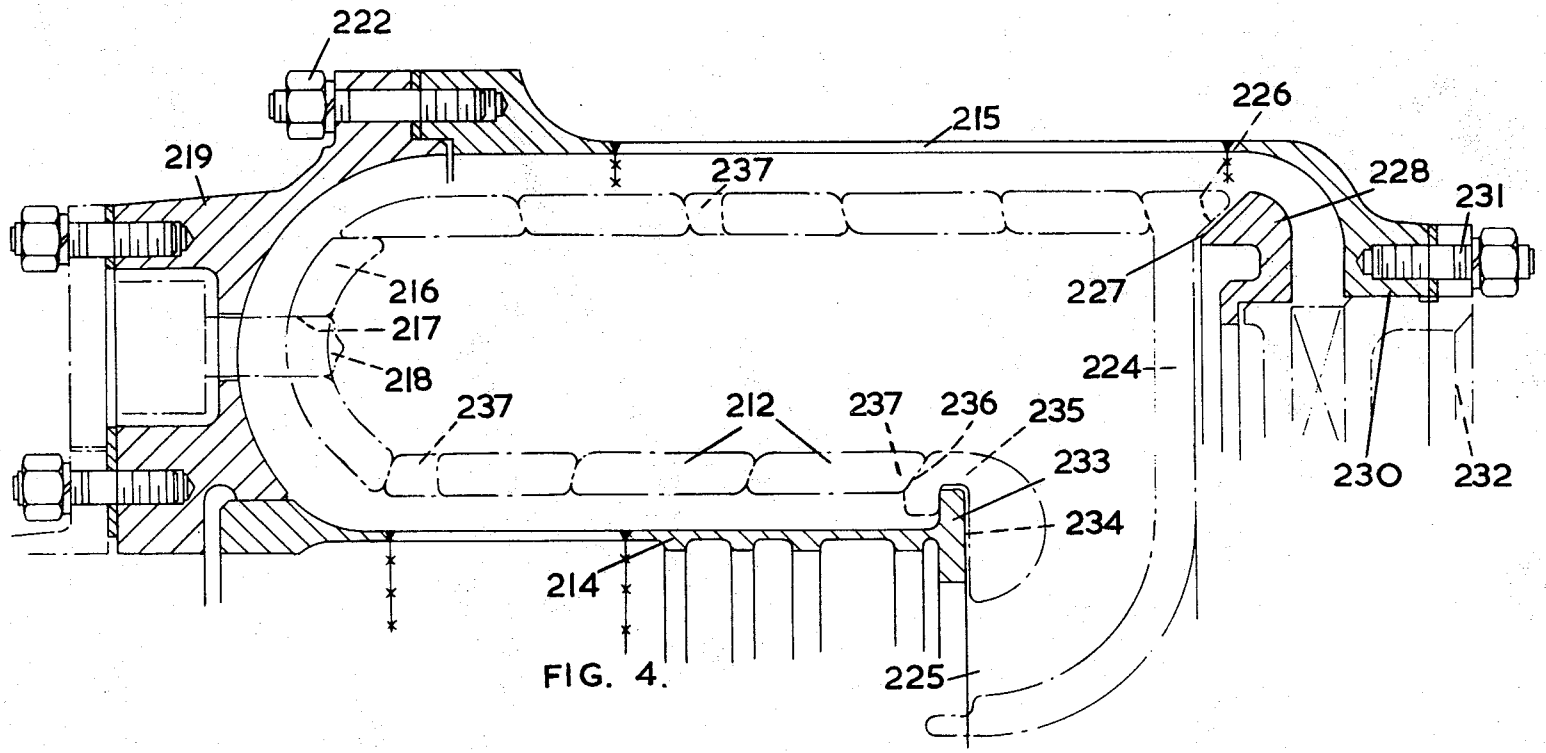
FIG. 4 is a longitudinal sectional view of part of another flame tube according to the present invention.
Figure 5:
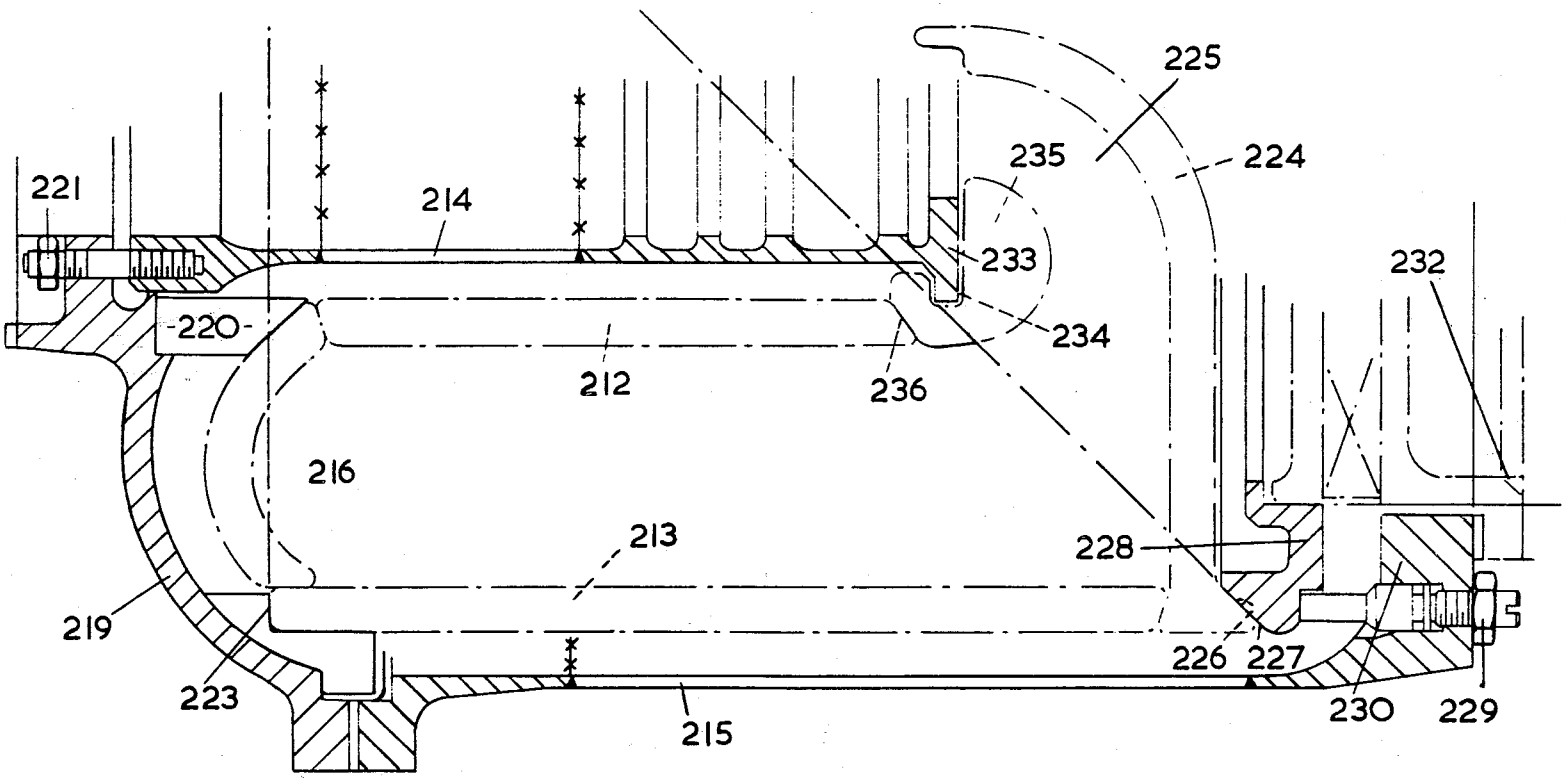
FIG. 5 is a longitudinal sectional view of another part of the flame tube of FIG. 4.

Referring now to FIGS. 4 and 5 of the drawings, the flame tube illustrated therein is similar to those of FIGS. 1 to 3 in that inner and outer rows of rings 212 and 213 of silicon nitride are provided adjacent inner and outer annular casing walls 214 and 215, respectively.

At one end of the rows of rings 212, 213 there is provided an annular ceramic ring 216 which is of generally C-shaped cross-section and which has a plurality of angularly spaced apertures 217 therethrough (only one shown, see FIG. 4). Each aperture 217 accommodates a fuel atomizer nozzle 218 (only one shown) which is adapted to produce a flat, fan shaped spray pattern. The ceramic ring 216 is supported in position by an end plate 219 through the intermediary of a plurality of support elements 220 (only one shown), FIG. 5. The end plate 219 serves to inter-connect the inner and outer casing walls 214, 215 respectively and is attached by respective bolts 221 and 222 (only one shown of each) and the pressure applied on ceramic ring 216 by support elements 220 can be varied by appropriate adjustment of bolts 221. The outer end of ceramic ring 216 abuts against the inwardly facing surfaces of adjacent outer ring 213 while the inner end of ring 216 abuts against the adjacent end of adjacent inner ring 212, with the abutment extending over a frusto-conical surface. Parts of the outer ring 213 adjacent ring 216 abut against peripherally spaced shoulders 223 (only one shown, FIG. 5) which are fixed relative to end plate 219. The engagement between ring 213 and abutments 223 occurs in a plane Q which lies perpendicularly to the longitudinal axis of the flame tube.

At the opposite end of the outer row of rings 213, there is provided a further annular, ceramic ring 224 which defines the outer wall of an annular outlet 225 of the combustion chamber of the flame tube. The ceramic ring 224 engages, adjacent its outer periphery, against the adjacent end of adjacent ring 213. On the opposite side of ring 224 to ring 213, the ring 224 is provided with a frusto-conical surface 226 which is engaged with a corresponding frusto-conical surface 227 on a metal collar 228. The two surfaces 226 and 227 are urged into mutual engagement by means of a series of adjusting screws 229 (only one shown, FIG. 5) engaged with collar 228 and mounted in a flange 230 which is disposed at the opposite end of the flame tube to end plate 219. The arrangement of the frusto-conical surfaces 226 and 227 is such that the notional apex thereof intersects the longitudinal axis of the flame tube in plane Q. In other words, straight lines emanating from a point of the flame tube axis pass through the engaging surfaces between respective rings 213 and abutments 223 and ring 224. Bolts 231 (only one shown, FIG. 4) secure an end plate 232 across the end of outer casing wall 215.

The inner casing wall 214 is provided at an end thereof remote from ceramic ring 216 with an annular rim 233. The rim 233 is engaged in an annular recess 234 formed in a composite ceramic ring 235. The composite ring 235 is formed in two halves to enable it to be located around rim 233. The composite ring 235 is provided with a frusto-conical surface 236 which engages with chamfered ends of the adjacent inner ring 212. The arrangement of the mutual engaging surfaces 226 and 227, with respect to plane Q ensures that relative radial expansion and contraction of the casing walls relative to the ceramic rings 213 is accommodated for with a minimum of risk of fracture of the rings.

Recesses 237 which are spaced apart peripherally of rings 212 and 213 are provided in the edges of certain of rings 212 and 213 to define air passages in the assembled flame tube.

I claim:

1. A flame tube comprising a casing having an outer annular wall and an inner annular wall, a plurality of monolithic ceramic rings within the casing in a side-by-side row, abutment means at one end of said row of ceramic rings, clamping means at the opposite end of said row urging said row against said abutment means, engaging surfaces between said abutment means and said row of ceramic rings and between said clamping means and said row of ceramic rings lying on straight lines emanating from a point on a longitudinal axis of the flame tube, said row of ceramic rings being mounted radially inwardly of said outer annular wall of said casing and a further row of ceramic rings and adjacent said inner annular wall of said casing, and further abutment means disposed at one end of said further row, and further clamping means at the opposite end of said further row urging said further row against said further abutment means.

2. The flame tube according to claim 1, wherein engaging surfaces between said further abutment means and said further row of ceramic rings and between said further clamping means and said further row of ceramic rings are so arranged that they lie on straight lines emanating from a point on said longitudinal axis of the flame tube.

3. The flame tube according to claim 1, wherein said clamping means for said row and said further row are carried on common clamping yokes angularly spaced apart around said longitudinal axis of the flame tube and adjustable towards and away from said abutment means and said further abutment means, respectively.

4. The flame tube according to claim 2, wherein mutually abutting ends of said ceramic rings of said row lie on conical surfaces which converge to their respective apices away from said abutment means.

5. The flame tube according to claim 4, wherein mutually abutting ends of said ceramic rings of said further row lie in conical surfaces which converge to their respective apices towards said further abutment means.

6. The flame tube according to claim 2, wherein said rows of rings are interconnected at one of their ends by an apertured, annular ceramic ring having a series of angularly spaced apertures therethrough, and fuel atomizer nozzles are disposed in said apertures.

7. The flame tube according to claim 6, wherein said fuel atomizer nozzles are each arranged to produce a fan-shaped spray.

8. The flame tube according to claim 6, wherein, at the opposite end of said row of rings, there is provided a further annular ceramic ring having a curved inner wall defining an outer wall of an annular outlet, and said clamping means acts on said further annular ceramic ring.

9. The flame tube according to claim 8 wherein, at the opposite end of said further row of rings, one of said further abutment means is defined by a composite ceramic annulus having an inwardly facing recess engaged around an annular rim on said inner wall of said casing, and said further clamping means acts upon said further row of rings through the intermediary of said apertured annular ceramic ring.

10. The flame tube according to claim 8, wherein said clamping means for said row of rings comprises a member having a frusto-conical surface engaging a corresponding surface on said further annular ceramic ring, said frusto-conical surface having a notional apex disposed at a point on said longitudinal axis which is in a plane in which lie said mutually engaging surfaces of said abutment means and said row.

* * * * *